US005269597A

United States Patent [19]

Yenglin et al.

[11] Patent Number: 5,269,597

[45] Date of Patent: Dec. 14, 1993

[54] DISPENSING RACK

[75] Inventors: Daniel J. Yenglin, Spring Lake; Bruce A. Anderson, Grand Haven, both of Mich.

[73] Assignee: Thomas F. Parker & Associates, Inc., Grand Haven, Mich.

[21] Appl. No.: 781,817

[22] Filed: Oct. 23, 1991

[51] Int. Cl.[5] ..... A47F 3/02

[52] U.S. Cl. ..... 312/42; 312/138.1; 312/216

[58] Field of Search ..... 312/42, 138.1, 216, 312/328, 215, 222; 211/4

[56] References Cited

U.S. PATENT DOCUMENTS 4,130,326 12/1978 Hornblad .
4,800,821 1/1989 Nook et al. .
4,915,460 4/1990 Nook et al. .

*Primary Examiner*—Kenneth J. Dorner
*Assistant Examiner*—Gerald A. Anderson
*Attorney, Agent, or Firm*—Price, Heneveld, Cooper, Dewitt & Litton

[57] ABSTRACT

A security system is provided for a dispensing rack on which cigarette cartons are stacked, the rack having a front face with an opening defined therein, at least one shelf for holding a stack of cartons thereon, and a shield for partially closing the opening to deter theft of the cartons placed on the shelf. The security system includes a corner bracket having an extrusion with an interior side adapted to receive an elongate support and also adapted to receive a lock bar assembly. An elongate support is mounted to the extrusion so as to securely support the shelf and also to pivotally support the shield in a cooperating manner so as to allow the shield to pivotally move between an open position wherein stacks of cartons can be added to the shelf, a first closed position wherein the cartons are protected from theft in-mass but can be removed individually from the bottom of the stack of cartons, and a second closed position wherein articles cannot be removed from the shelf. A lock is integrally-mounted in the corner bracket and is operably connected to a lock bar on the lock assembly so that the lock can actuate the lock bar to lock the shield in the closed position. In one embodiment, the corner bracket includes a slot that is adapted to receive the edge of a pricer graphic, the slot cooperating with a second corner bracket having an opposing slot such that the pricer graphic can be retainably placed into the opposing slots in a fastenerless manner to hold the pricer graphic on the side of the rack.

41 Claims, 4 Drawing Sheets

DISPENSING RACK

BACKGROUND OF THE INVENTION

The present invention relates to dispensing racks, and in particular to a security system for dispensing racks to deter theft of packages from such racks.

Cigarette cartons are a favorite target of shoplifters because of their high cost. However, a shoplifter must shoplift multiple cartons at a time in order to make the venture profitable. In order to shoplift multiple cartons, speed is of the essence, with the shoplifter swiftly removing the cartons from the rack when no one is looking and hiding them in concealed portions of their clothing or in a bag. A need exists for a security system for a dispensing rack which will inhibit a rapid removal of multiple articles of merchandise from the rack. Such a security system, however, must not interfere with an aesthetic display of the merchandise in a manner that provides visual perusal of the merchandise. Further, such a security system must not interfere with the normal removal of merchandise by customers, nor with the occasional restocking of the rack by store employees.

An additional higher level of security is required to discourage pilferage by store employees and the like who account for a large percentage of merchandise theft. Employee theft is often more difficult to prevent because the employee may have a longer time in which to remove merchandise.

One type of security system for dispensing racks was disclosed in U.S. Pat. No. 4,915,460 to Nook et al., the security system including an upper and lower shield that are rotatable into three different positions: a first closed position permitting cartons of cigarettes to be removed individually from the rack shelf, a second closed position preventing any cartons from being removed, and a third open position permitting efficient restocking of the shelf. An externally mounted locking system for locking the shields in the two closed positions is additionally disclosed.

However, still further improvement is desired. For example, the externally mounted locking system while effective, may detract from an aesthetically clean overall appearance of the front face of the rack. Further, due to the external placement, the locking system may be subject to damage or abuse. Also, it is desirable to reduce the number of parts used and cost of producing same while increasing their manufacturability. Still further, improvements are desired in ease and speed of assembly. Additionally, it is desirable to adapt the rack so that it can readily receive electronic equipment intended to deter theft from the shelf, and also support pricing or advertising materials that are typically displayed adjacent the shelf or hung on the shelf. Optimally, these features would be achieved while maintaining the knockdown construction of the rack.

Accordingly, the need exists for a security system that solves the aforementioned problems.

SUMMARY OF THE INVENTION

In one form, the present invention is a security system for a dispensing rack adapted to dispense articles having a predetermined height from the bottom of a stack of such articles, the rack including a face with an opening having at least one shelf therein. The security system includes a shield partially covering the opening having a lower edge forming an access space with the associated shelf. The shield is pivotally mounted to the rack so as to move between a closed position whereby articles can be removed individually from the shelf through the access space and an open position whereby the shelf can be readily restocked. The lateral end portions of the shield include a lock receiving means for locking the shield in the closed position, the lock receiving means being located rearward of the front face of the rack when the shield is in the closed position. The security system further includes a corner bracket having a front that forms a part of the rack front face, a lock engaging means located behind the front for engaging the lock receiving means on the shield to lock the shield in a locked closed position, and a lock integrally mounted in the corner bracket and operably connected to the lock engaging means. The lock is movable between a locked position and an unlocked position so that actuation of the lock moves the lock engaging means into and out of engagement with the lock receiving means, respectively, whereby the shield can be locked in the closed position by actuating the lock.

In another form, the security system includes a shield that is positionable in a first closed position across the rack opening wherein individual articles may be removed from the shelf, a second closed position wherein individual articles cannot be removed from the shelf, and an open position permitting restocking of the shelf.

In another form, the invention is a corner bracket that cooperates with a rack having at least a shelf and shield, the corner bracket including an extrusion, an elongate support mounted to the extrusion for supporting the shelf and shield, and a lock bar assembly adapted to lock the shield in a closed position. A lock is integrally mounted in the extrusion and operably attached to the lock assembly so that the lock assembly can be moved into engagement with the shield in a locked position.

In still another form, a corner bracket is provided which incorporates means for retaining a pricer graphic, and separately, a chamber for receiving electronic equipment intended to deter theft.

The present invention offers several advantages over known art. Initially, the invention provides a security system that has an aesthetically clean and flush appearance, the locking feature of the system being substantially hidden and unobtrusive in nature. Further, the security system is useable on shields having two different closed positions, the different closed positions offering varying levels of security and theft deterrence. Still further, the security system is compatible with a knockdown rack that can be readily moved from store to store, and assembled by non-skilled labor with a minimum of man-hours. Additionally, the security system can be used with racks having multiple shelves and shields located at different and rearrangeable heights, all of the shelves and shields being lockable by use of an integral lock located at the top of each of a pair of corner brackets. Each corner bracket is located on a side of the front of the rack.

Still further, the security system includes a corner bracket that is made in a single extrusion to simplify manufacture and reduce cost. The corner bracket includes features that allow it to receive a shelf and shield support, and a lock bar assembly. A lock can be mounted integrally into the top of the corner bracket, and attached to the lock bar assembly in a substantially hidden protected area within the corner bracket. The corner bracket further provides an aesthetically clean front surface that is flush with the shields and rack front face. In the preferred form, the corner bracket additionally provides a groove for fastener-free attachment of a pricer graphic on the end of the rack, and also a chamber permitting positioning of drop-in theft deterrence electronics such as an infrared sensor.

These and other objects, advantages, and features of this invention will become apparent upon review of the following specification in conjunction with the drawings.

DETAILED DESCRIPTION OF THE DRAWINGS

DETAILED DESCRIPTION OF THE PREFERRED EMBODIMENT

Figure 1:
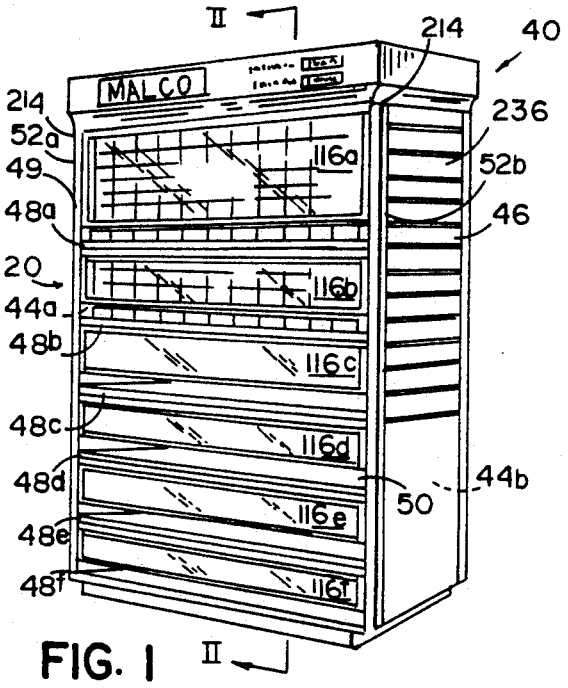
FIG. 1 is a perspective view of a dispensing rack incorporating a security system according to the invention.

For purposes of description herein, the terms "upper," "lower," "left," "right," "rear," "front," "vertical," "horizontal," and derivatives thereof shall relate to the article display and vending device as oriented in FIG. 1. However, it is to be understood that the invention may assume various alternative orientations, except where expressly specified to the contrary. It is also to be understood that an item designated by a numeral followed by an alphabet character is either identical to or a mirror image of another item designated by the same numeral followed by a different alphabet character. In such circumstances a reference to the numeral designation alone is a reference to both such items.

Figure 2:
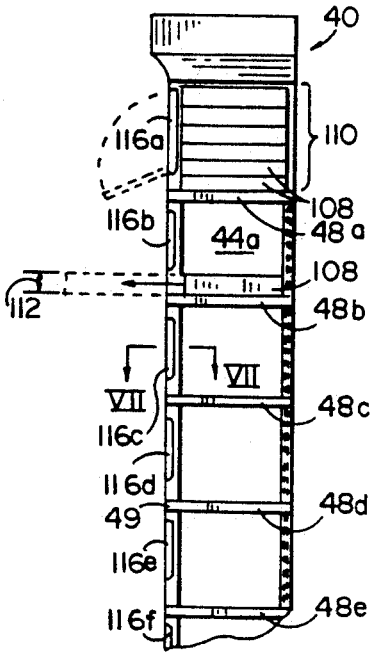
FIG. 2 is partial section taken along the lines II—in FIG. 1.
Figure 3:
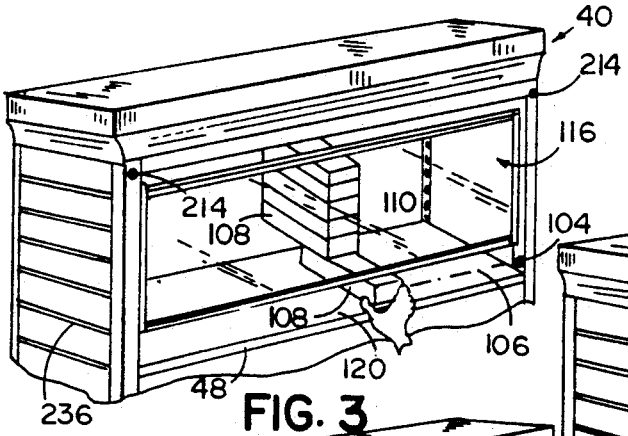
FIGS. 3-5 are partial perspective views illustrating the various positions of a shield.
Figure 4:
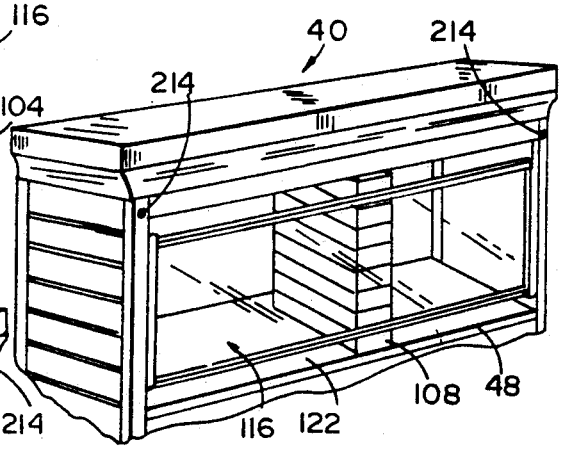
Figure 5:
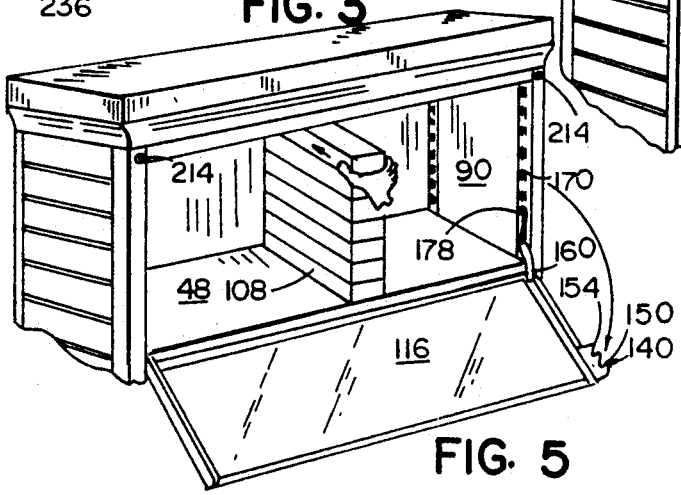

A security system embodying the present invention is shown in FIGS. 1 and 2 and is generally designated as numeral 20. Security system 20 is particularly adapted for use with a dispensing rack 40 for dispensing articles 108 having a predetermined height 112 from the bottom of a stack 110 of such articles. The system 20 in the instant case dispenses cartons of cigarettes. The system is adaptable however for use on any rack wherein it is desirable to provide a first level of protection wherein articles are removable individually from the rack (FIG. 3), a second level of protection wherein articles cannot be removed (FIG. 4), and a third level wherein access to the articles is substantially uninhibited to permit efficient restocking of rack 40 (FIG. 5).

Rack 40 is substantially disclosed in U.S. Pat. No. 4,915,460 to Nook et al., issued Apr. 10, 1990 entitled "Security System for Dispensing Racks" and also in U.S. Pat. No. 4,800,821 to Nook et al., issued Jan. 31, 1989, entitled "Dispensing Rack", the entire contents of both of which are incorporated hereinafter by reference except as modified below.

Referring specifically to the drawings, dispensing rack 40 includes a pair of end panels or sidewalls 44*a* and 44*b* interconnected at their top by a top panel (not shown) and at their bottom by a bottom panel (not shown). A rear panel (not shown) joins the rear edge portions of end panels 44 and the top and bottom panels. Dispensing rack 40 additionally includes a plaque or pricer graphic 46 located on sidewalls 44 for displaying advertising. A plurality of horizontal shelves 48*a-f* are supported within rack 40 in a manner that provides adjustability of the vertical spacing 30 between shelves 48*a-f*. End panel forward portions 45 (FIG. 7) and the top and bottom panels define a front face 49 (FIG. 1) which surrounds and defines an opening 50 in the dispensing rack. Security system 20 is mounted to dispensing rack 40 over opening 50 in order to selectively provide access to merchandise such as articles 108 displayed on shelves 48*a*–48*e* (FIGS. 3-5) with the articles 108 being stacked in stacks 110 on shelves 48. In the embodiment shown, articles 108 are cartons of cigarettes having a predetermined height 112, but it is contemplated that the articles could be any merchandise having a predetermined height.

Figure 6:
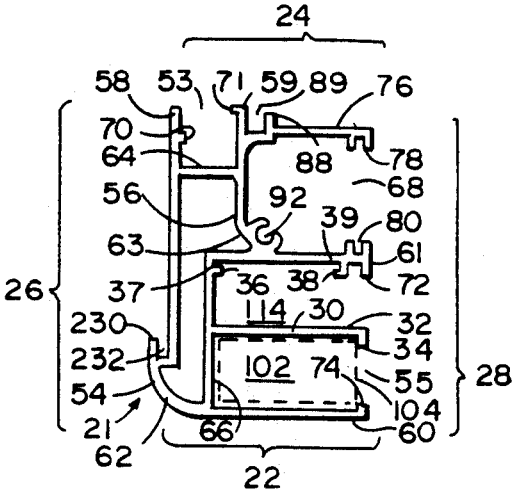
FIG. 6 is a sectional view of an extrusion for a corner bracket.
Figure 9:
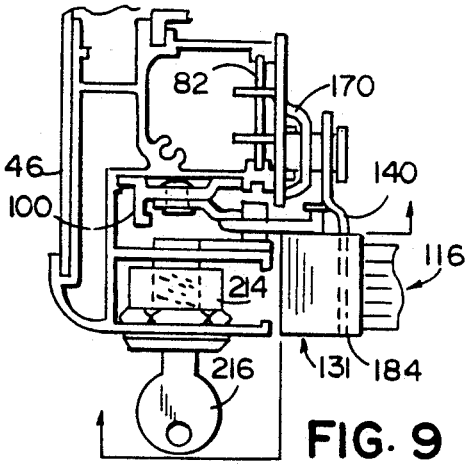
FIG. 9 is similar to FIG. 7, but with the lock bar assembly being in a locked position.
Figure 10:
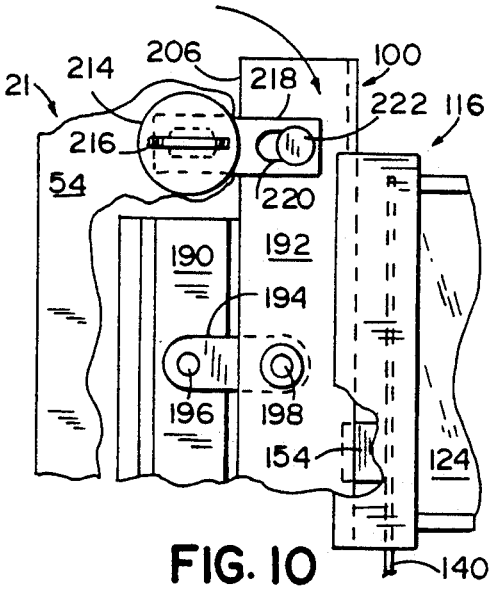
FIG. 10 is a partial front view of the corner bracket in FIG. 9 partially broken-away to better show the lock bar assembly in a locked position.

In the illustrated embodiment (FIGS. 1 and 7) front face 49 includes a pair of corner brackets 52*a* and 52*b* which are mirror images of each other and extend forwardly from end panels 44*a* and 44*b*, respectively. Each corner bracket 52 (FIG. 6) includes an extrusion 21 having a front 22, a rear 24, an exterior side 26, and an opposing interior side 28. Extrusion 21 comprises two generally arcuately shaped walls 54, 56 disposed in a mutually parallel but offset relationship. Corner bracket walls 54 and 56 include outer ends 58 and 59, inner ends 60 and 61, and curved or rounded medial sections 62 and 63, respectively outer ends 58 and 59 being located along extrusion rear 24 and outer end 60 and 61 being located along extrusion interior side 28. Additionally, wall 54 includes an offset forming a groove 232 for retaining a price graphic 236 discussed below. Two continuously extending integrally formed webs 64 and 66 rigidly interconnect corner bracket walls 54 and 56 and retain the same in a spaced-apart relationship.

An intermediate wall 30 extends from web 66 toward extrusion interior side 28 in a direction parallel and between walls 54 and 56, intermediate wall 30 terminating at outer end 32. Outer end 32 includes a rib 34 at its terminal end that extends toward outer wall 54. Intermediate wall 30 forms a channel or pocket 102 with wall 54 and web 66. Electronics (not shown) such as an infrared sensor in a box-like cartridge 104 (shown in phantom) can be placed within channel 102 and retained by rib 34 and 74 therein adjacent a shelf 48 so that electronic cartridge 104 shines a beam 106 (FIG. 2) in front of shelf 48 for detecting the removal of articles 108. The electronics can be programmed to sound various signals to forewarn store employees that one or more articles 108 have been taken. Similarly, intermediate wall 30 forms a channel or pocket 114 with web 66 and wall 56 for receiving a lock bar assembly 100, discussed hereinafter.

A rearward face 53 located on rear 24 of each extrusion 21 defines a first pocket with web 64 and walls 54 and 56, and includes two ribs 70 and 71 which engage compatible grooves in end panels 44 to retain the end panels to the corner brackets. An inward face 55 located on interior side 28 of each extrusion 21 defines a second pocket with web 66 and walls 54 and 56, and includes two ribs 72 and 74 which extend inwardly from the interior surfaces of walls 54 and 56. Ribs 34, 72 and 74 are disposed along the terminal edge of bracket walls 30, 54 and 56 at interior side 28. Hence, ribs 72 and 74 and 34 are oriented generally parallel. A flange 76 extends laterally inwardly toward interior side 28 from bracket wall 56 adjacent outer end 59. Flange 76 includes a U-shaped groove 78 at a free end thereof, which faces forwardly towards outer end 61 of wall 56. A mating U-shaped groove 80 is positioned on inner bracket wall 56 adjacent end 61, faces inwardly, and is laterally aligned with grooves 78. A flange 36 on web 66 and an L-shaped flange 38 located at end 61 of wall 56 form opposing U-shaped grooves 37 and 39 respectively, for insertably receiving a lock bar assembly 100.

Flange 76 further includes a lip 88 at its base adjacent end 59 of wall 56, lip 88 forming a rearwardly facing U-shaped groove 89 for receiving an edge 91 of a sidewall closeout panel 90 that provides an aesthetic inner sidewall surface for enclosing articles 108 on shelves 48. Medial section 63 also includes a U-shaped pocket for receiving a rod for anchoring extrusion 21 on rack 40, or for mounting accessories such as wire routing clips (not shown) and the like in space 68.

Corner brackets **52*a* and 52*b* extend the entire vertical height of rack 40 and have substantially a consistent cross-sectional shape throughout their entire lengths. Corner bracket 52*a* and 52*b* also each include a slotted upright member or elongate support 82 (FIGS. 7 and 12) that is slideably received between U-shaped grooves 78 and 80 and extends the entire length of each bracket 52. Uprights 82 are located parallel to each other and in mutually facing relationship, and are perforated by two columns of rectangular slots 84 and 86. Slots 84 and 86 on the pair of uprights 82*a* and 82*b* are oriented on the same horizontal plane. A horizontal shelf support beam (not shown) has laterally extending hook members which are received in slots 84 and 86 in order to provide a support for the front portion of a particular shelf 48*a*–48*e***.

A single shield 116 (FIG. 3) is provided for each shelf 48 on rack 40. Each shield 116 has a predetermined shield height 118 sufficient in height and width to substantially cover the opening between the associated shelf 48 of the shield and the next above adjacent shelf, but with the shield height 118 being cut short at least the height 112 of an article 108. Thus with shield 116 in a "day access" or first closed position, shield 116 forms an access space 120 between the lower horizontal edge of shield 116 and the upper front edge of the associated shelf 48, access space 120 being sufficient in size to allow individual removal of articles 108 from the bottom of stacks 110.

Shield 116 can also be moved to a "night lock up" or second closed position (FIG. 4) wherein shield 116 is lowered so that a reduced access space 122 is formed. Reduced access space 122 is sufficiently small in height so that articles 108 cannot be removed from between shelves 48 and shields 116 either below or above shields 116. Shield 116 can further be moved to an open position (FIG. 5) permitting efficient restocking of articles 108 onto shelves 48.

Figure 11:
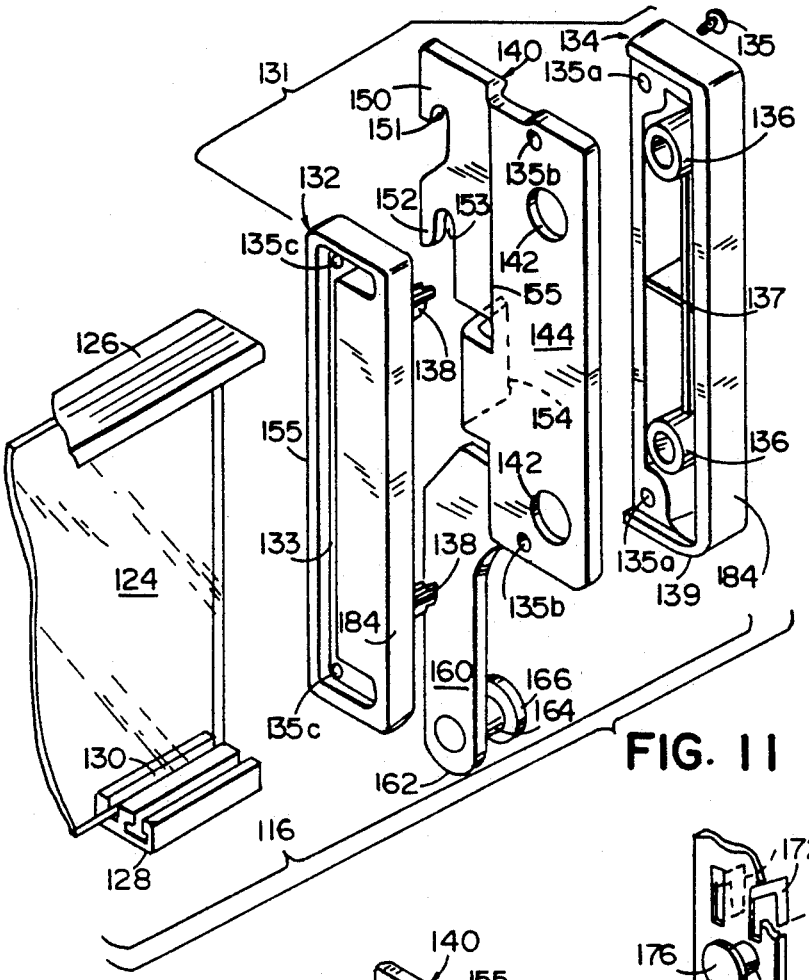
FIG. 11 is a partial exploded perspective view of a shield.

Shield 116 (FIG. 11) includes a plexiglas or otherwise transparent sheet of material 124 reinforced along its upper and lower horizontal edges by upper and lower extrusions 126 and 128, each extrusion 126 and 128 including a groove 130 to receive and cover the sharp edges of plexiglas 124. Shield 116 also includes opposing lateral end portions 131 (only one of which is shown). Each end portion 131 is comprised of two end cap inner and outer halves 132 and 134 which close on and retain a mounting bracket 140 in a sandwich-like relationship, outer half 134 including a aesthetic lip 139 that extends around three sides of half 134 and permits racket 14 to extend rearwardly without interference. Plexiglas 124 and extrusions 126, 128 assemble into a C-shaped profile having an end that is closely received into plastic end cap inner half 132 in a C-shaped groove 133. A screw 135 fits through holes **135*a*–*c* and into extrusion 126/128 to retain same on inner/outer halves 132, 134. Outer end cap half 134 includes hollow locating bosses 136 that receive protrusions 138 extending from inner half 132. Halves 132 and 134 are reinforced by ribs 137** as necessary to form a rigid part.

A mounting bracket 140 (FIGS. 11 and 12) includes two spaced holes 142 that receive bosses 136 as halves 132 and 134 ar assembled to the body 144 of bracket 140 forming the sandwich-like arrangement. Notably, the body 144 of bracket 140 and halves 132, 134 can be of any height desired to match the size of plexiglas sheet 124, though only one size is shown. The forward portion of body 144 is shaped to mateably fit within lip 139 of outer half 134.

Located near the upper part of body 144 and forward of holes 142, 148 are two downwardly facing hooks 50 and 152 with notches 151 and 153 formed therein, respectively, hook 150 being located vertically above hook 152. In the preferred embodiment, hooks 150, 152 are laterally offset toward a side by a bend 155 in body 144 so that hooks 150, 152 are positioned closely to a side of opening 50 in rack 40. This allows hooks 150, 152 to more securely engage shield retaining bracket 170 for holding shield 116 in a closed position.

Just below bottom hook 152 (FIGS. 11 and 12) on mounting bracket 140 is a laterally extending tab 154. With halves 132, 134 assembled to mounting bracket 140, tab 154 is spaced rearwardly from the rearwardmost surface 155 of inner half 132 and thus forms a channel or lock bar receiving means 156 (FIG. 7) for receiving a lock bar 158. Tab 154 extends laterally sufficiently to permit reliable engagement by lock bar 192, but is at the same time short and stiff enough to prevent bending when engaged in a locked position.

Mounting bracket 140 further includes a lower rearwardly extending portion 160 that is in the shape of an inverted L-shaped pattern. At the lower terminal end 162 of portion 160 is a normally extending round stud 164 with head 166 that projects laterally outwardly toward a side of rack 40.

An elongated retainer or attaching bracket 170 (FIGS. 7 and 12) includes at least two pairs of hooks 172 adapted to securely engage slots 84 and 86 in elongate support 82, one pair being near the top of bracket 170 and the other pair being near the bottom. A round stud 174 with head 176 protrudes laterally from bracket 170 on an opposite side from hooks 172 near the top of bracket 170. Near the bottom of bracket 170, a slot 178 with enlarged top 180 is formed, the area around slot 178 being deformed outwardly around the marginal area 182 around slot 178 away from the side having hooks 172.

Figure 12:
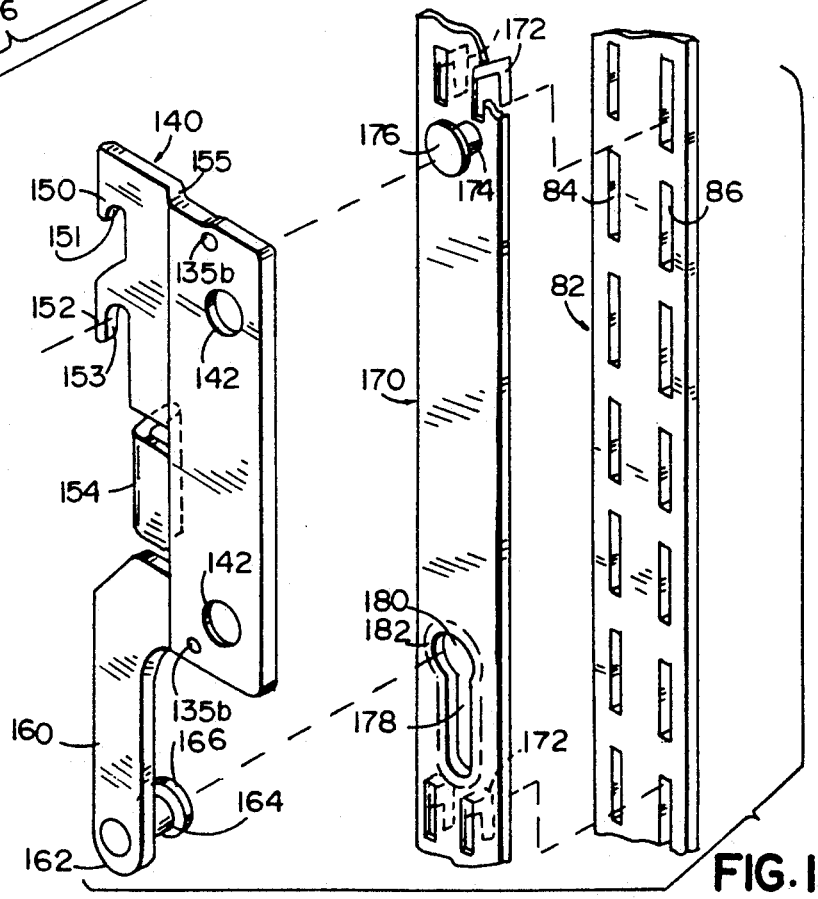
FIG. 12 is a partial exploded perspective view of a shield mounting arrangement.
Figure 13:
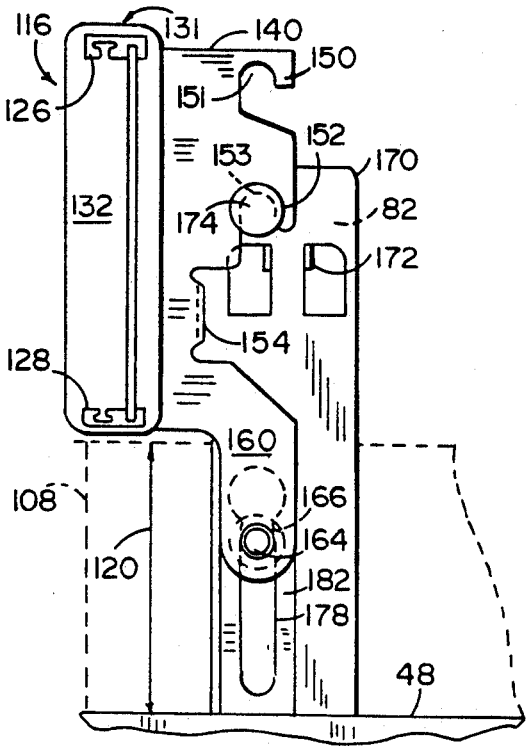
FIG. 13 is a side view of the shield lateral end bracket attached in a first closed position.

As best shown in FIGS. 12 and 13, shield 116, and in particular mounting bracket 140, can be operably mounted to attaching bracket 170 by inserting stud 164 of mounting bracket 140 of lateral end portion 131 into slot 178 so that head 166 fits into the deformed area 182 on attaching bracket 170. With bottom notch 153 of hook 152 engaged on stud 174, shield 116 is held in the day access position wherein access space 120 is formed between the bottom edge of shield 116 and the associated shelf 48.

Figure 14:
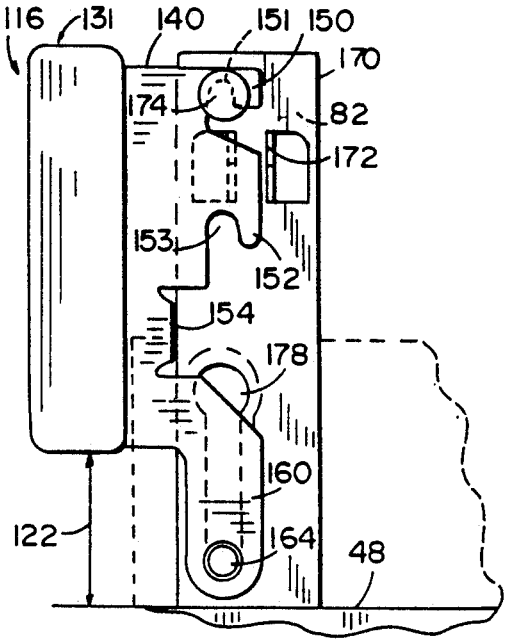
FIG. 14 is a side view of the shield lateral end bracket attached in a second closed position.

By lifting shield 116 upwardly slightly, notch 153 of hook 152 is disengaged. Shield 116 can then be tilted outwardly and lowered so as to engage upper second notch 151 of hook 150 (FIG. 14). In this second position, shield 116 and shelf 48 present a reduced access space 122 wherein articles 108 cannot be removed either below or above shield 116.

Figure 15:
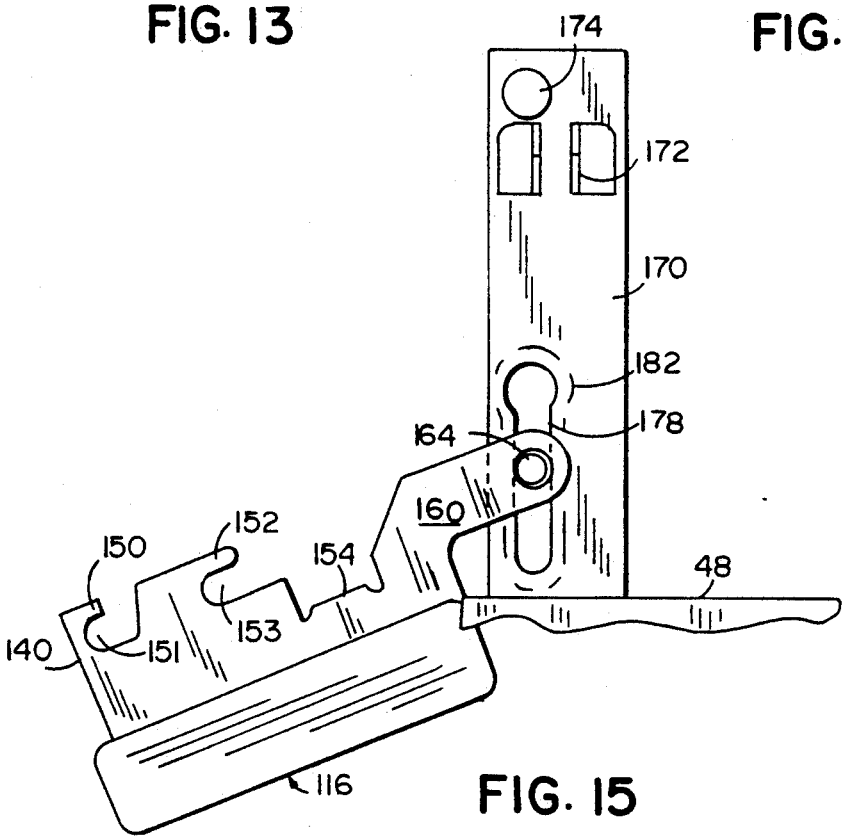
FIG. 15 is a side view of the shield lateral end bracket attached in an open position.

Alternatively, shield 116 can be lifted upward slightly to disengage notches 151, 153 and rotated about stud 164 on a horizontal axis defined by stud 164 so that shields 116 can be pivoted to an open position (FIG. 15) for restocking articles 108 onto shelves 48.

It is desirable to lock shields 116*a–f* in the first or second closed positions. For this purpose a lock bar assembly 100 is provided (FIGS. 7–10). Lock bar assembly 100 (FIG. 8) includes an elongated lock bar retainer bracket 190 and a lock bar 192 interconnected by multiple spaced pivoting links 194, each link 194 being pivotally attached at its ends to bracket 190 and bar 192 by rivets 196 and 198 such that lock bar 192 is at all times parallel to lock bar retainer bracket 190 as it moves laterally from side to side. Lock bar retainer bracket 19 (FIG. 7) includes opposing laterally extending lips 200 and 202 that engage grooves 37, 39 respectively in corner bracket 52. Bracket 190 further includes an overcenter stop 204 that abuts lock bar 192 and prevents same from over-rotating past the unlocked position. Lock bar 192 is substantially an elongate flat strip and includes an abutting surface 206 for engaging stop 204, and also includes an opposing engaging edge 208 with reinforcing ridge 210. Engaging edge 208 is movable into engagement with all tabs 154 of a given end (RH or LH) of shields 116*a–f* to lock all shields 116 in a locked closed position (FIGS. 9 and 10), or is movable out of engagement into a recessed or unlocked position wherein tabs 154 are released (FIGS. 7 and 8) and shields 116 can be moved to an open position for restocking shelves 48 or to a different closed position.

Figure 7:
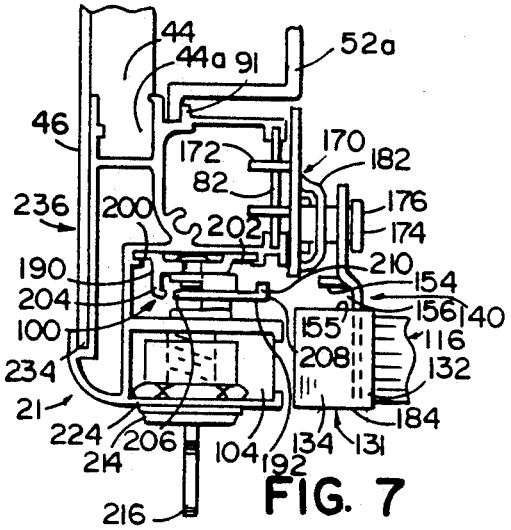
FIG. 7 is a partial section taken along lines VII—VII in FIG. 2, the lock bar assembly being in an unlocked position
Figure 8:
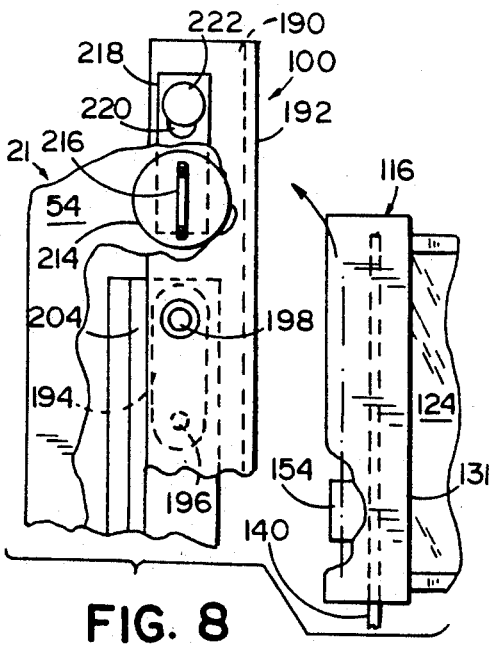
FIG. 8 is a partial front view of the corner bracket in FIG. 7 partially broken-away to better show the lock bar assembly in an unlocked position.

A key operated lock 214 actuatable by key 216 is attached to extrusion 21 through a hole 224 in the top of wall 54. Lock 214 includes an operative end attached to a driver link 218. Link 218 includes a slot 220 and is attached to lock bar 192 by pin 222 which slides in slot 220. Slot 220 allows for dimensional variations during manufacture and facilitates assembly. As key 216 turns lock 214, lock bar 192 is moved between an engaged or locked position wherein shields 116 are locked closed (FIGS. 9 and 10) and a disengaged or unlocked position wherein shields 116 are unlocked and can be moved (FIGS. 7 and 8).

Notably, in either of the closed positions (FIGS. 9 or 7) lateral end portion 131 presents a forward edge surface 184 on cap halves 132, 134 that is flush with front 22 of corner bracket 20 of rack 40. Also, optimally, the extrusion front 22 forms rack front face 49 without the use of appliques or aesthetic covers, thus reducing parts and assembly time. Still further, corner bracket 52 and security system 20 is compatible with a knockdown rack construction, though it need not be limited to such.

Figure 16:
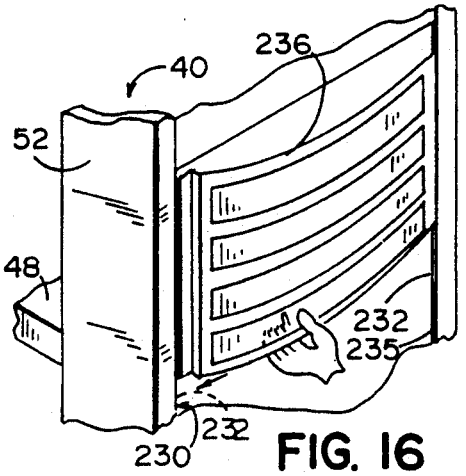
FIG. 16 is a perspective view showing installation of a pricer graphic.

Extrusion 21 of corner bracket 52 is optimally provided with an elongate lip 230 (FIG. 7) along exterior side 26 in wall 54 forming a groove or slot 232 for receiving a mating edge 234 of a pricer graphic 236. A pricer graphic 236 (FIG. 16) is commonly used on the sidewalls 44 of rack 40 or otherwise adjacent rack 40 to display product logo, advertising literature, and product pricing information. By providing opposing grooves 232 in opposing corner bracket extrusions, a pricer graphic 236 made from a resiliently flexible sheet such as plastic or cardboard can be flexed and retainably inserted into grooves 232 without the use of fasteners or other tools (as is shown in FIG. 16). Further, it is contemplated that a thermoformed sheet can be made with secondary grooves (not shown) so that pricing cards can be retainably inserted into the secondary grooves, thus facilitating price changes of individual products.

Even if the security system illustrated in FIGS. 1–16 is left unlocked, shoplifting is deterred because cartons of cigarettes may only be individually removed from the stacks without first manipulating the shields to the stocking position. While access may be readily gained to the space between shelves to restock the shelves, a deliberate manipulation of the shields, which may not be apparent to a potential shoplifter and which is noticeable and causes delay, is required. Thus, a basic level of security is provided.

An additional level of security is provided according to the invention by the lockup system which selectively locks the security system in a dispensing mode, in which access to the merchandise is denied except through the single-carton access space. In this mode, shoplifting is substantially deterred because cartons may be removed only individually. However, the transparent nature of the shield assembly allows viewing of the merchandise which, above all, is the essential purpose of a dispensing rack. Additionally, the security system does not substantially detract from the aesthetic appearance of the dispensing rack due to its flush appearance and substantially hidden lock bar assembly. With the lockup feature, the security system is provided with a selectable night lockup position in which the shield is lowered to a reduced access space. In this position, the contents of the merchandise are still observable through the upper and lower shields but access to the merchandise is denied.

A security system according to the invention interfaces with a knockdown type of dispensing racks disclosed in patents referred to above. This is accomplished by providing shields of selected various heights in order to accommodate various shelf spacings. Additionally, although such a knockdown dispensing rack is readily assembled or disassembled with simple tools, once the security system is placed in the night lockup position covering substantially the entire opening of the rack, it is secure and not subject to being defeated by disassembly without first unlocking the locks to gain access to the interior of the rack. The use of common parts, which greatly reduces the number and complexity of the components of the system, reduces its costs and increases its flexibility. Notably, a single shape extrusion 21 can be inverted for use on both left and right sides of rack 40.

Further, the extrusion utilized in the present invention provides a flush, aesthetically pleasing front surface that is unobtrusive. Also the locking means are integral, reducing parts and also reducing the likelihood of damage or tampering. The preferred embodiment includes an integral lock mounted in the extrusion front that is readily accessible. Further, the front provides a channel or recess for receiving electronic sensing equipment adjacent shelves for sensing when articles are removed therefrom. Also, the extrusion provides an integral means for attaching pricer graphics without the use of fasteners or special tools.

Changes and modifications in the specifically described embodiments can be carried out without departing from the principles of the invention. For example, although the invention is disclosed in an embodiment for merchandising cigarette cartons, it may find application in merchandising other goods. The protection afforded the invention is intended to be limited only by the scope of the appended claims, as interpreted according to the principles of patent law including the Doctrine of Equivalents.

The embodiments of the invention in which an exclusive property or privilege is claimed are defined as follows:

1. A security system for a dispensing rack adapted to dispense articles having a predetermined height from the bottom of a stack of such articles, said rack having a front face and a sidewall, means defining an opening in said face, and a shelf positioned in said opening for supporting a stack of articles, said security system comprising:

a shield having a lower edge spaced above said shelf and a first pair of opposite lateral end portions, said shield being positioned across said opening with said lower edge being spaced from said shelf substantially equal to or greater than said predetermined height of said articles to define an access space between said shield lower edge and said shelf to remove said articles individually from the bottom of said stack;

mounting means for pivotally mounting said shield proximate said front face such that said shield will pivot about an axis located rearward of said front face between a first closed position facially adjacent said front face and an open position outwardly away from said front face, whereby said shelf may be restocked with articles when said shield is in said open position;

said lateral end portions of said shield including receiving means for locking said shield in said first closed position, said receiving means being located rearward of said front face of said rack when said shield is in said first closed position;

a corner bracket for said rack extending vertically and positioned adjacent said lateral end portions when said shield is in said first closed position, said corner bracket including a front portion and further including an engaging means located behind said front portion for engaging said receiving means on said shield to lock said shield in a locked closed position; and a lock positioned in said corner bracket and operably connected to said engaging means, said lock being movable between a locked position and an unlocked position so that actuation of said lock moves said engaging means into and out of engagement with said receiving means, respectively, whereby said shield can be locked in said first closed position by actuating said lock.

2. The apparatus as set forth in claim 1 wherein said shield is adapted to move to a second closed position wherein said shield is positioned across said opening with said lower edge being spaced from said shield a distance less than said predetermined height of said articles to define a reduced access space between said shield lower edge and said shelf so that said articles cannot be individually removed from the bottom of said stack, whereby theft of said articles is deterred.

3. The apparatus as set forth in claim 2 including a plurality of said shields, and wherein said engaging means includes a movable lock bar that operably engages each of said plurality of said shields when in said first or second closed positions to prevent movement of said shields when said lock is moved to said locked position.

4. The apparatus as set forth in claim 3 wherein said receiving means includes tab means for lockingly receiving said lock bar such that said lock bar moves into engagement with said tab means when said lock is moved to said locked position, and moves out of engagement with said tab means when said lock is moved to said unlocked position.

5. The apparatus as set forth in claim 4 wherein said lateral end portions each include a forward edge that is flush with said front portion of said corner bracket when said shield is in said closed position.

6. The apparatus as set forth in claim 1 wherein said corner bracket includes an elongate support including means for holding said shield while in said closed position, and said lateral end portions include a mounting bracket with a first notch that engages said means for holding said shield.

7. The apparatus as set forth in claim 6 wherein said elongate support includes means for pivotally attaching said shield to said elongate support, and said mounting bracket includes a rearwardly extending portion that is attachable to said mounting means.

8. The apparatus as set forth in claim 7 wherein said mounting bracket includes a second notch spaced from said first notch, said second notch being useful for engaging said means for holding said shield in a second closed position different than said first closed position, said means for pivotally attaching said shield permitting vertical movement of said shield so that said shield can be positioned in said second closed position, said shield when in said second closed position preventing said articles from being removed from the bottom of said stack whereby theft of said articles is deterred.

9. The apparatus as set forth in claim 1 wherein said corner bracket includes a chamber for receiving electronics to deter theft, said chamber adapted to position said electronics adjacent said access space.

10. The apparatus as set forth in claim 1 wherein said corner bracket includes an exterior side, and said exterior side includes means for retainably receiving one end of a pricer graphic.

11. The apparatus as set forth in claim 10 wherein said means for receiving a pricer graphic includes an elongate lip formed therein defining a laterally extending groove which is adapted to receive a mating edge of a pricer graphic.

12. The apparatus as defined in claim 11 including a second corner bracket spaced from said first corner bracket, said first and second corner brackets being attached to said sidewall, said second corner bracket having a laterally extending groove adapted to receive an opposing mating edge on the pricer graphic, wherein the pricer graphic can be retainably inserted into said opposing grooves of said first and second corner brackets so that the pricer graphic covers a portion of said sidewall.

13. The apparatus for set forth in claim 1 including a first and a second corner bracket, said first and second corner brackets being located on either side of said rack face, said first and second corner brackets each having a front defining the vertical sides of said opening in said rack face.

14. The apparatus as set forth in claim 1 wherein said shield is movable to a second closed position different than said first closed position.

15. The apparatus as set forth in claim 1 wherein said shield is located partially behind said front portion of said corner bracket when said shield is in said closed position.

16. The apparatus as set forth in claim 1 wherein said rack is a knock down rack and said elongate support is removably mounted in said corner bracket.

17. The apparatus as set forth in claim 1 including an elongate support attached to said corner bracket for supporting said shelf and adapted to adjustably position said shelf at different heights within said rack.

18. The apparatus as set forth in claim 1 wherein said corner bracket front portion forms a part of said rack front face.

19. A security system for a dispensing rack adapted to dispense articles having a predetermined height from the bottom of a stack of such articles, said rack having a front face, means defining an opening in said face, and a shelf positioned in said opening for supporting a stack of articles, said security system comprising:

a shield having a lower edge spaced above said shelf and a first pair of opposite lateral and portions, said shield being positionable in a first closed position across said opening with said lower edge being spaced from said shelf substantially equal to or greater than said predetermined height of said articles to define an access space between said shield lower edge and said shelf to remove said articles individually from the bottom of said stack, said shield also being positionable in a second closed position wherein said shield is positioned across said opening with said lower edge being spaced from said shelf a distance less than said predetermined height of said articles to define a reduced access space between said shield lower edge and said shelf so that said articles cannot be individually removed from the bottom of said stack, whereby theft of said articles is deterred, said lateral end portions of said shield defining means for securely holding said shield in either of said first and second closed positions;

mounting means for operably mounting said shield to said front face such that said shield will operably move between said closed positions facially adjacent said front face and pivotably move to an open position outwardly away from said front face, whereby said shelf may be stacked with articles with said shield in said open position; and a corner bracket for said rack extending vertically and positioned adjacent said lateral end portions when said shield is in one of said closed positions, said corner bracket including a lock and means connected to said lock for engaging said means for securely holding said shield to lock said shield in a selected one of said first and second closed positions.

20. In a dispensing rack having a sidewall and front face, means defining an opening in said face, at least one shelf positioned in said opening for supporting one or more stacks of articles thereon, and at least one shield for partially closing said opening to deter theft of said articles, the improvement comprising:

an extrusion including a front forming a part of said rack front face, a rear including means for attaching to a panel forming said rack sidewall, an exterior side and an opposing interior side, said interior side including means for receiving an elongate support and means for operably receiving a lock bar assembly;

an elongate support adapted to attach to said interior side of said extrusion and including means for attaching said shelf and also means for pivotally attaching said shield at heights corresponding to said shelf so that said shield can be pivoted between an open position wherein said articles can be loaded onto said shelf and a closed position wherein said shield partially closes said opening;

a lock bar assembly adapted to attach to said extrusion in a position behind said front of said extrusion and including a movable lock bar that can be moved between a locked position wherein said lock bar engages said shield when in said closed position and an unlocked position wherein said lock bar disengages said shield and said shield can be moved to said open position; and a lock integrally mounted in said extrusion, said lock operably connected to said movable lock bar so that actuation of said lock locks said shield in said closed position.

21. The apparatus as set forth in claim 20 wherein said shield includes a pair of opposite lateral end portions, said end portions defining a tab means for lockingly receiving said lock bar such that said lock bar moves into engagement with said tab means when in said locked position and moves out of engagement with said tab means when in said unlocked position.

22. The apparatus as set forth in claim 20 wherein said exterior side of said extrusion includes means for retainably receiving a pricer graphic.

23. The apparatus as set forth in claim 20 including a second extrusion, said first and second extrusions being located on either side of said rack face with said front of said first and second extrusions defining the vertical sides of said opening in said rack face.

24. The apparatus as set forth in claim 20 wherein said shield is adapted to move to a second closed position wherein said articles cannot be individually removed from the bottom of said stack of articles, and said lock bar is adapted to engage said shield in either of said first and second closed positions.

25. The apparatus as set forth in claim 24 wherein said shield includes lateral end portions including tabs and said lock bar interferingly engages said tabs when in said locked position.

26. The apparatus as set forth in claim 20 wherein said shield is located flush or behind said front of said extrusion when said shield is in said closed position.

27. A dispensing rack assembly comprising:

a rack having a pair of parallel, laterally spaced sidewalls, a front face defined by a forward edge portion of said sidewalls, an opening defined between said sidewalls, and at least one shelf positioned in said opening, a pair of parallel elongate corner brackets including extrusions attached to each of said sidewalls on opposite sides of said front face, said corner brackets including shelf support means for supporting said shelf in a selectable position in said rack;

a first shield having a forwardly facing surface, upper and lower edge portions and a first pair of opposite lateral end portions;

attachment means for attaching said first shield to said corner brackets at a selectable position in said rack so that said shield defines an access space between said lower horizontal edge portion and said shelf, said attachment means attaching said first shield in a manner so that said first shield will selectively pivot about an axis that is spaced below said lower edge portion, whereby said first shield is pivotable between a closed position against said face in which merchandise articles may be individually removed from said self through said access space and an open position away from said face in which said shelf may be stocked with merchandise; and locking means for locking said shield integrally mounted to said corner bracket in a position substantially behind said front face, said locking means including an engaging means for engaging one of said opposite lateral end portions of said shield when in said closed position and an unlocked position wherein said shield is movable from said closed position to said open position.

28. The apparatus as set forth in claim 27 wherein said engaging means includes a lock bar assembly adapted to attach to said corner bracket in a position behind said rack front face, said lock bar assembly including a movable lock bar that can be moved between a locked position wherein said lock bar engages said shield when in said closed position and an unlocked position wherein said lock bar disengages said shield and said shield can be moved to said open position.

29. The apparatus as set forth in claim 28 wherein said shield includes a pair of opposite lateral end portions, said end portions defining a tab means to lockingly receive said lock bar such that said lock bar moves into engagement with said tab means when in said locked position and moves out of engagement with said tab means when in said unlocked position.

30. The apparatus as set forth in claim 27 wherein said corner bracket includes an exterior side having means for retainably receiving one end of a pricer graphic.

31. The apparatus as set forth in claim 27 wherein the front of the extrusions define the sides of said opening in said rack face.

32. The apparatus as set forth in claim 27 wherein said shield is movable to a second closed position located below said first closed position, said shield when in said second closed position preventing said articles from being removed as a unit from the bottom of said stack.

33. The apparatus as set forth in claim 27 wherein said corner brackets each include a chamber for receiving electronics to deter theft, said chamber adapted to position said electronics adjacent said access space.

34. The apparatus as set forth in claim 27 wherein said lateral end portions includes tabs and said lock engaging means includes a lock bar that interferingly engages said tabs when in said locked position.

35. The apparatus as set forth in claim 27 wherein said shield is located partially behind said front of said corner bracket extrusion when said shield is in said closed position.

36. In a dispensing rack having a sidewall formed by a panel and a front face, means defining an opening in said face, at least one shelf positioned in said opening for supporting a stack of articles thereon, and at least one shield for partially closing said opening to deter theft of said articles, the improvement comprising:

an extrusion including a front, a rear including means for attaching to the panel forming said rack sidewall, an exterior side and an opposite interior side, said interior side including means for receiving an elongate support, said exterior side including a laterally extending longitudinal lip forming a means for receiving an edge of a pricer graphic, said means for receiving being adapted to position said pricer graphic partially over said panel forming said sidewall;

an elongated support including means for attaching to said extrusion on said interior side of said extrusion; and means for pivotally attaching said shield to said elongate support at heights corresponding to said shelf so that said shield can be pivoted between an open position wherein said opening is enlarged so that said articles can be easily loaded onto said shelf, and a closed position wherein said shield partially closes said opening, said shield when in said closed position defining a space with said shelf so that said articles can be removed only individually from the bottom of said stack.

37. The apparatus as set forth in claim 36 wherein said longitudinal lip defines a laterally extending groove which is adapted to receive a mating edge of a pricer graphic.

38. The apparatus as defined in claim 37 including a second extrusion spaced from said first extrusion, said second extrusion having a corresponding opposing laterally extending groove adapted to receive an opposing mating edge of the pricer graphic, wherein the pricer graphic can be bowed and retainably inserted into the opposing grooves of said first and second corner brackets, whereby the pricer graphic partially covers said side wall.

39. The apparatus as set forth in claim 38 wherein the front of said extrusions define the sides of said opening in said rack face.

40. The apparatus as set forth in claim 36 wherein said means for receiving a pricer graphic defines means for holding the pricer graphic without the use of separate fasteners.

41. The apparatus as set forth in claim 36 wherein said extrusion includes a front that forms a part of said rack front face.

* * * * *

UNITED STATES PATENT AND TRADEMARK OFFICE

CERTIFICATE OF CORRECTION

PATENT NO. : 5,269,597

DATED : December 14, 1993

INVENTOR(S) : Daniel J. Yenglin et al.

It is certified that error appears in the above-indentified patent and that said Letters Patent is hereby corrected as shown below:

Column 3, line 16:
"II-in" should be --II-II in--.

Column 4, line 24:
After "spacing" delete --30--.

Column 6, line 17:
"including a" should be --including an--.

Column 6, line 19:
"14" should be --140--.

Column 6, line 31:
"134 ar" should be --134 are--.

Column 7, line 39:
"bracket 19" should be --bracket 190--.

Column 11, line 13:
"for set" should be --as set--.

UNITED STATES PATENT AND TRADEMARK OFFICE

CERTIFICATE OF CORRECTION

PATENT NO. : 5,269,597

DATED : December 14, 1993

INVENTOR(S) : Daniel J. Yenglin et al.

It is certified that error appears in the above-indentified patent and that said Letters Patent is hereby corrected as shown below:

Column 11, line 43:
"lateral and" should be --lateral end--.

Signed and Sealed this

Nineteenth Day of July, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,269,597

DATED : December 14, 1993

INVENTOR(S) : Daniel J. Yenglin et al

It is certified that error appears in the above-indentified patent and that said Letters Patent is hereby corrected as shown below:

Column 10, line 12, "shield" should be —shelf—.

Signed and Sealed this

Twenty-third Day of August, 1994

Bruce Lehman

*Attest:*

BRUCE LEHMAN

*Attesting Officer*

*Commissioner of Patents and Trademarks*